US010801294B2

(12) United States Patent
Jespersen et al.

(10) Patent No.: US 10,801,294 B2
(45) Date of Patent: Oct. 13, 2020

(54) ADJUSTABLE FRACTURING MANIFOLD MODULE, SYSTEM AND METHOD

(71) Applicant: Stream-Flo Industries Ltd., Edmonton (CA)

(72) Inventors: Michael David Jespersen, Edmonton (CA); Glen Murray Eleniak, Ardrossan (CA); Jerry Wakeford, Sherwood Park (CA)

(73) Assignee: Stream-Flo Industries Ltd., Edmonton (CA)

( * ) Notice: Subject to any disclaimer, the term of this patent is extended or adjusted under 35 U.S.C. 154(b) by 62 days.

(21) Appl. No.: 16/102,507

(22) Filed: Aug. 13, 2018

(65) Prior Publication Data

US 2020/0048980 A1 Feb. 13, 2020

(51) Int. Cl.
*E21B 33/068* (2006.01)
*E21B 43/26* (2006.01)
(Continued)

(52) U.S. Cl.
CPC ..... *E21B 33/068* (2013.01); *E21B 34/02* (2013.01); *E21B 43/12* (2013.01); *E21B 43/26* (2013.01)

(58) Field of Classification Search
None
See application file for complete search history.

(56) References Cited

U.S. PATENT DOCUMENTS 8,469,108 B2 6/2013 Kajaria et al.
8,474,521 B2 7/2013 Kajaria et al.
(Continued)

OTHER PUBLICATIONS

Cameron, *Frac manifold systems*, [Brochure]. Retrieved from https://www.slb.com/fracmanifolds (copyright 2016, Schlumberger).
(Continued)

*Primary Examiner* — Matthew R Buck
*Assistant Examiner* — Douglas S Wood
(74) *Attorney, Agent, or Firm* — Leydig, Voit & Mayer, Ltd.

(57) ABSTRACT

A fracturing manifold module of a fracturing manifold system for controlling the flow of fracturing fluid from a shared manifold trunk line to a plurality of wellheads each adapted for fracturing a well. The fracturing manifold module includes a transport skid adapted to be ground supported and a flow control unit supported on the transport skid and including an inlet adapted for connection along an axis of the shared manifold trunk line, an outlet adapted for connection to one of the plurality of wellheads via one or more fluid conduits, and one or more flow control valves between the inlet and the outlet. The transport skid and the flow control unit are connected together to provide for rotation of the flow control unit relative to the transport skid in a generally horizontal x-y plane relative to the ground, said rotation being about a z-axis perpendicular to the x-y plane to provide for adjustable connection to the fracturing manifold system at one or both of the inlet and the outlet. Also provided is a fracturing system with a plurality of the fracturing manifold modules, and a method of aligning a fracturing manifold module for connection to the shared manifold trunk line.

47 Claims, 8 Drawing Sheets

(51) Int. Cl.
*E21B 43/12* (2006.01)
*E21B 34/02* (2006.01)

(56) References Cited

U.S. PATENT DOCUMENTS

| | | | |
|---|---|---|---|
| 8,813,836 | B2 | 8/2014 | Kajaria et al. |
| 8,839,867 | B2 | 9/2014 | Conrad |
| 8,899,268 | B2 | 12/2014 | Garner et al. |
| 8,978,763 | B2 | 3/2015 | Guidry |
| 9,004,104 | B2 | 4/2015 | Ungchusri et al. |
| 9,068,450 | B2 | 6/2015 | Guidry |
| 9,127,545 | B2 | 9/2015 | Kajaria et al. |
| 9,222,345 | B2 | 12/2015 | Conrad |
| 9,239,125 | B2 | 1/2016 | Ungchusri et al. |
| 9,255,469 | B2 | 2/2016 | Conrad |
| 9,416,637 | B2 | 8/2016 | Allouche |
| 9,518,430 | B2 | 12/2016 | Guidry |
| 9,534,604 | B2 | 1/2017 | Lopez et al. |
| 9,568,138 | B2 | 2/2017 | Arizpe et al. |
| 9,605,525 | B2 | 3/2017 | Kajaria et al. |
| 9,631,469 | B2 | 4/2017 | Guidry et al. |
| 9,759,054 | B2 | 9/2017 | Gay et al. |
| 9,903,190 | B2 | 2/2018 | Conrad et al. |
| 9,915,132 | B2 | 3/2018 | Conrad |
| 9,932,800 | B2 | 4/2018 | Guidry |
| 10,132,146 | B2 | 11/2018 | Guidry |
| 2016/0376864 | A1 | 12/2016 | Roesner et al. |
| 2017/0159654 | A1 | 6/2017 | Kendrick |
| 2017/0268306 | A1 | 9/2017 | Kajaria et al. |
| 2017/0275980 | A1 | 9/2017 | Kajaria |
| 2017/0306987 | A1 | 10/2017 | Theodossiou |
| 2017/0314379 | A1 | 11/2017 | Guidry |
| 2017/0350223 | A1 | 12/2017 | Guidry et al. |
| 2017/0370172 | A1 | 12/2017 | Tran et al. |
| 2017/0370199 | A1 | 12/2017 | Witkowski et al. |
| 2018/0058171 | A1 | 3/2018 | Roesner et al. |
| 2018/0073308 | A1 | 3/2018 | Tran et al. |
| 2018/0187507 | A1 | 7/2018 | Hill et al. |
| 2018/0187537 | A1 | 7/2018 | Hill et al. |
| 2018/0347286 | A1* | 12/2018 | Scott ..... E21B 17/05 |
| 2020/0103078 | A1 | 4/2020 | Scott et al. |

OTHER PUBLICATIONS

E&P, Roesner, T., et al. *Solving Inefficiencies of Fracturing Fluid Delivery*, [Brochure]. (Retrieved Dec. 19, 2017 from https://www.epmag.com/solving-inefficiencies-fracturing-fluid-delivery-825386.

Performance Wellhead & Frac Components, *Frac Manifold Solutions*, "[Brochure[." Retrieved from https://www.pwfrac.com/products/frac-manifold-solutions (n.d.).

Weir Oil & Gas, *Seaboard™ zip pac manifold systems*, "[Brochure]." Retrieved from https://www.global.weir.com (copyright 2014, Seaboard).

* cited by examiner

ADJUSTABLE FRACTURING MANIFOLD MODULE, SYSTEM AND METHOD

FIELD OF THE INVENTION

This invention relates in general to hydrocarbon well stimulation equipment and methods for downhole hydraulic fracturing, and in particular, to equipment, systems and methods used in multi-pad drilling and fracturing operations in order to align skid mounted fracturing manifold modules of a fracturing manifold system for adjustable connection to a shared fracturing manifold trunk line.

BACKGROUND OF THE INVENTION

Current methods for completing hydrocarbon wells often require initial high pressure fracturing fluids to be introduced to hydraulically fracture the formation, increasing permeability and allowing the flow of hydrocarbons during production. The stimulation services provide the high pressure fracturing fluid, which is transported through the fracturing manifold system to fracturing trees rated for the high-pressure stimulation on the wellheads. On multi-pad well sites, the fracturing manifold system controls the flow of the fracturing fluid to the corresponding well being stimulated and isolates flow to the other wells.

This process of hydraulic fracturing ("fracking") creates hydraulic fractures in rocks, to increase the output of a well. The hydraulic fracture is formed by pumping a fracturing fluid into the wellbore at a rate sufficient to increase the pressure downhole to a value exceeding the fracture gradient of the formation rock. The fracture fluid can be any number of fluids, with chemical additives, ranging from water to gels, foams, nitrogen, carbon dioxide, acid or air in some cases. The pressure causes the formation to crack, allowing the fracturing fluid to enter and extend the crack further into the formation. To maintain the fractures open, propping agents are introduced into the fracturing fluid and pumped into the fractures to extend the breaks and pack them with proppants, or small spheres generally composed of special round quartz sand grains, ceramic spheres, or aluminum oxide spheres. The propped hydraulic fracture provides a high permeability conduit through which the hydrocarbon formation fluids can flow to the well.

At the surface, hydraulic fracturing equipment for oil and natural gas fields usually includes frac tanks holding fracturing fluids and proppants which are coupled through supply lines to a slurry blender, one or more high-pressure fracturing pumps to pump the fracturing fluid to the frac head of the well, and a monitoring unit. Fracturing equipment operates over a range of high pressures and injection rates. Many frac pumps are typically used at any given time to maintain the very high, required flow rates into the frac head and into the well.

The high pressure fracturing fluid flows to the inlet of shared fracturing manifold trunk lines (also known as zipper manifolds), through a single large diameter high-pressure line or multiple smaller diameter high-pressure lines. The inlet block of the shared fracturing manifold trunk line is fluidly connected to one of the fracturing manifold modules (also known as manifold leg or zipper module), or between two fracturing manifold modules, and additional fracturing manifold modules are connected together with a single shared manifold trunk line. The shared fracturing manifold trunk line may include joints, which may or may not be adjustable. Each fracturing manifold module typically corresponds to a single well for stimulation. The flow control unit components of the fracturing manifold module typically include an inlet (for example an inlet tee, cross or block) to align and connect to the shared manifold trunk line, one or more control valves (typically two, for example gate valves or plug valves) and an outlet (for example an outlet tee, cross or block) to align to the well. The outlet connects to the fracturing tree on the wellhead through one or more high-pressure conduit lines or multiple high-pressure lines that may include connection blocks, pipe sections and possibly pivot or swivel joints.

The fracturing manifold modules may be pre-assembled prior to transporting to the well pad and may be skid mounted. The skid may include one or multiple fracturing manifold modules, wherein each module includes the flow control unit components of an inlet, one or more control valves and an outlet. Each of these manifold modules is attached together at the inlet with the shared manifold trunk line, commonly with flanged connections and metal sealing gaskets. When making up this flanged connection, the flange faces must be aligned, that is parallel and coaxial with the axis of the shared manifold trunk line for integrity of the metal seal.

Due to the high-pressure rating required for the fracturing manifold equipment, each manifold module and skid commonly exceeds 20,000 lbs. A high capacity crane at the well pad is typically used to support and align each manifold module and skid when making up this connection to the shared fracturing manifold trunk line. Supporting the skid by crane, while aligning the connection at the inlet, is tedious, time consuming, and costly. As well, the crane supported skid connection to the shared manifold trunk line creates additional risks for workers.

SUMMARY

In some embodiments, the subject invention reduces or eliminates the need for a high capacity crane in building the high pressure portions of a fracturing manifold system. A high capacity crane, if used at all, approximately locates each fracturing manifold module proximate to one of the plurality of wellheads or to the shared manifold trunk line, and then is not involved in aligning and making the connections of each fracturing manifold module to the shared fracturing manifold trunk line and to the plurality of wellheads.

In some embodiments, the fracturing manifold module of this invention is pre-assembled prior to transport and landing, and provides for adjusting such that one or both of the inlet and the outlet of the manifold module can be axially aligned for connection to the fracturing manifold system using rotation, and preferably also translational movement, between a flow control unit that includes the inlet and the outlet, and a transport skid with supports the flow control unit.

In some embodiments, the flow control unit and the transport skid are connected together with a plurality of independently controlled, actuated cylinders, to provide for rotation of the flow control unit relative to the transport skid in a generally horizontal x-y plane relative to the ground, the rotation being about a z-axis perpendicular to the x-y plane to provide for adjustable connection to the fracturing manifold system at one or both of the inlet and the outlet.

In some embodiments the transport skid and the flow control unit are also connected together for translational movement of the flow control unit relative to the transport skid for movement in the x-y plane, for example in the direction of both a y-axis and an x-axis of the fracturing manifold module.

In some embodiments, the fracturing manifold module also provides for height adjustment to level the flow control unit relative to the ground.

By providing both translational and rotational movement between the flow control unit and the transport skid, preferably also with height adjustment, the fracturing manifold module achieves adjustable connection in each of the x, y and z directions to connect the inlet in alignment with the axis of the shared manifold trunk line, herein termed the y-axis of the shared manifold trunk line. This allows the connection at the inlet to be made up in a safe and time effective manner. This also allows the high capacity crane, if needed at all, to quickly and approximately locate each fracturing manifold module, and then move on to assist in other stimulation services set-up rather than remaining for further connections in the fracturing manifold system.

Broadly stated, the present disclosure provides a fracturing manifold module of a fracturing manifold system for controlling the flow of fracturing fluid from a shared manifold trunk line to a plurality of wellheads each adapted for fracturing a well. The fracturing manifold module includes a transport skid adapted to be ground supported and a flow control unit supported on the transport skid. The flow control unit includes an inlet adapted for connection along an axis of the shared manifold trunk line, an outlet adapted for connection to one of the plurality of wellheads via one or more fluid conduits, and one or more flow control valves between the inlet and the outlet. The transport skid and the flow control unit are connected together to provide for rotation of the flow control unit relative to the transport skid in a generally horizontal x-y plane relative to the ground, the rotation being about a z-axis perpendicular to the x-y plane to provide for adjustable connection to the fracturing manifold system at one or both of the inlet and the outlet.

In some embodiments of the fracturing manifold module, the transport skid and the flow control unit are connected together to provide for translational movement of the flow control unit relative to the transport skid in the x-y plane, for example in the direction of a y-axis of the fracturing manifold module which is adapted to extend parallel to the y-axis of the shared manifold trunk line, and an x-axis of the fracturing manifold module extending perpendicularly to the y-axis of the fracturing manifold module in the x-y plane, to provide for adjustable connection to the fracturing manifold system at one or both of the inlet and the outlet.

In some embodiments of the fracturing manifold module, the rotation about the z-axis and the translational movement of the flow control unit in the x-y plane relative to the transport skid are provided by a plurality of independently controlled, actuated cylinders, for example three or more cylinders, at least one cylinder being oriented to provide the translational movement in the direction of either the x-axis or the y-axis, and at least two cylinders oriented to provide the translational movement in the direction of the other of the x-axis or the y-axis, such that movement of both an x-axis directional cylinder and a y-axis directional cylinder provides the rotation about the z-axis.

In some embodiments of the fracturing manifold module, the transport skid and the flow control unit are further adapted to provide for height adjustment along the z-axis to level the flow control unit relative to the ground and to provide for adjustable connection to the fracturing manifold trunk line at one or both of the inlet and the outlet.

In some embodiments, the flow control unit is connected to a flow control frame for fixed movement therewith, while the transport skid remains ground supported and stationary. The flow control unit frame is supported on the transport skid and is connected to the transport skid through the plurality of cylinders to provide the rotation and the translational movement relative to the transport skid. The flow control unit components of the inlet, outlet and flow control valves may be pedestal mounted to the flow control frame and aligned along an x-axis of the flow control unit frame. In other embodiments, the flow control unit components may be aligned along a z-axis.

In another broad aspect, the present disclosure provides a fracturing system for controlling the flow of fracturing fluid to a plurality of wellheads, each adapted for fracturing a well. The fracturing system includes a fracturing manifold system connected to the plurality of wellheads for delivering fracturing fluid to the plurality of wellheads. The fracturing manifold system includes a shared manifold trunk line and a plurality of fracturing manifold modules connected to the shared manifold trunk line for controlling the flow of the fracturing fluid from the shared manifold trunk line to one of the plurality of wellheads. Each of the fracturing manifold modules includes a transport skid adapted to be ground supported, and a flow control unit supported on the transport skid and including an inlet adapted for connection along an axis of the shared manifold trunk line, an outlet adapted for connection to one of the plurality of wellheads via one or more fluid conduits, and one or more flow control valves between the inlet and the outlet. The transport skid and the flow control unit are connected together for rotation of the flow control unit relative to the transport skid in a generally horizontal x-y plane relative to the ground, said rotation being about a z-axis perpendicular to the x-y plane to provide for adjustable connection to the fracturing manifold system at one or both of the inlet and the outlet.

In yet another broad aspect, the present disclosure provides a method of aligning a fracturing manifold module for connection to a shared manifold trunk line of a fracturing manifold system. The method includes:

providing a flow control unit, the flow control unit including an inlet adapted for connection along an axis of the shared manifold trunk line, an outlet adapted for connection to one of a plurality of wellheads via one or more fluid conduits, and one or more flow control valves between the inlet and the outlet;

supporting the flow control unit on a transport skid adapted to be ground supported, the flow control unit and the transport skid being connected together to provide for rotation of the flow control unit relative to the transport skid in a generally horizontal x-y plane relative to the ground, said rotation being about a z-axis perpendicular to the x-y plane;

landing the transport skid and flow control unit for proximity to the shared manifold trunk line and to one of the plurality of wellheads; and adjusting the position of the flow control unit by rotating the flow control unit relative to the transport skid in the x-y plane about the z-axis to align one or both of the inlet and the outlet for connection to the fracturing manifold system.

In some embodiments of the method, the transport skid and the flow control unit are connected together to provide for translational movement of the flow control unit relative to the transport skid in the x-y plane. In such embodiments, the adjusting step further includes translating the flow control unit relative to the transport skid in the x-y plane to align one or both of the inlet and the outlet for connection to the fracturing manifold system.

In some embodiments, the method includes landing the transport skid and the flow control unit such that the transport skid is ground supported, and leveling the flow control unit in the x-y plane relative to the ground by adjusting the height of the flow control unit.

BRIEF DESCRIPTION ON THE DRAWINGS

Certain embodiments of the above features, aspects and advantages of the invention are described in greater detail with reference to the accompanying drawings in which like characters represent like parts throughout the drawings, in which:

FIG. 1 illustrates a portion of a fracturing system in accordance with one embodiment of the present disclosure in which a plurality of fracturing manifold modules, here five, are axially aligned and connected via the inlets to a shared fracturing manifold trunk line. The shared manifold trunk line receives high pressure fracturing fluid at inlet block(s), as pumped from the stimulation services S. The shared manifold trunk line is connected through the flow control unit components of each fracturing manifold module and through one or more fluid conduits at the outlet to one of the plurality of wellheads W, the outlet connections and the wellheads being shown schematically in the Figure.

FIG. 2 is a perspective view of a fracturing manifold module of the fracturing system of FIG. 1 showing additional details in accordance with one embodiment of the disclosure in which the flow control unit components of an inlet, an outlet and two valves, are pedestal mounted on a flow control unit frame, which is in turn supported on a lower transport skid. The flow control unit components are mounted for fixed movement with the flow control unit frame. To provide for adjustable connection along the y-axis of the shared manifold trunk line at the inlet, the flow control unit frame and the transport skid are connected together to allow for rotation of the flow control unit relative to the transport skid in an x-y plane relative to the ground and about a z-axis perpendicular to the x-y plane (Rz), and for translational movement in each of the x and y directions, as shown in the cartesian coordinates inset. The transport skid is also provided with height adjustable legs for leveling the flow control unit relative to the ground, thus providing for vertical adjustment in the z-direction. The fracturing manifold module is shown in the pre-assembled and locked position for transport and landing.

FIG. 3 is a side perspective view of the fracturing manifold module of FIG. 2 with the flow control unit frame partially cut away to show additional details of the frame system for each of the flow control unit frame and the transport skid, a plurality of independently controlled, actuating cylinders (three) pivotally connected between the flow control unit frame and the transport skid, and a friction reducing member provided at the points of contact between the flow control unit frame and the transport skid.

FIG. 4 is a side perspective view of the fracturing manifold module of FIG. 2 showing height adjustable legs on the transport skid to level the flow control unit, its components, and its frame relative to the ground. Leg locking mechanisms on each leg lock the legs against further movement. A releasable locking device between the flow control unit frame and the transport skid locks against relative movement.

DETAILED DESCRIPTION OF THE INVENTION

Fracturing System

Figure 1:
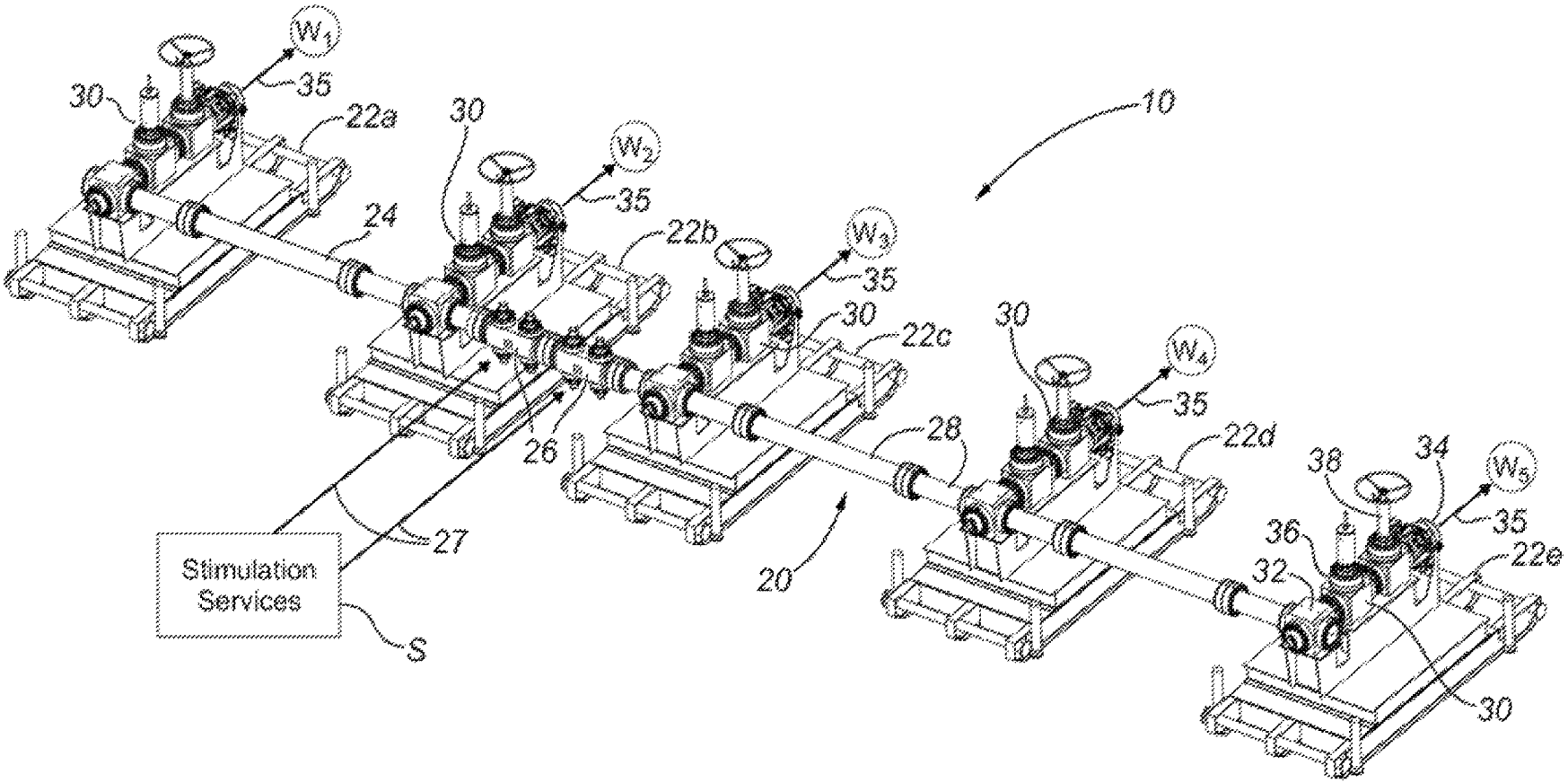

One embodiment of a fracturing system is shown generally at 10 in FIG. 1. A plurality of wellheads $W_1$-$W_5$, each adapted for fracturing a well in a manner known in the industry, receives a high pressure fracturing fluid pumped from stimulation services S (as described above) through a fracturing manifold system 20 which includes a plurality of fracturing manifold modules 22. FIG. 1 shows five identical fracturing manifold modules 22*a*-22*e* connected to a shared manifold trunk line 24, although in other embodiments, the fracturing manifold modules may vary one from another both in respect of the components included, and the connections to the fracturing manifold system 20. The shared manifold trunk line 24 of FIG. 1 is shown to include two inlet blocks 26 located between two adjacent fracturing manifold modules 22*b*, 22*c*, receiving the high pressure fracturing fluid from the stimulation services S via fluid conduits 27, and a plurality of interconnected spacer spools 28 between other of the adjacent fracturing manifold modules 22*a*-22*e*. In FIG. 1, the shared manifold trunk line 24 extends along an aligned, common center axis, which is herein referred to as the y-axis of the shared manifold trunk line 24. As noted above, the connections along the shared manifold trunk line 24 are commonly flanged connections with metal sealing gaskets, so the flange faces are sufficiently aligned, that is parallel and coaxial with the axis of the shared manifold trunk line 24, in order to preserve the integrity of the metal seal. It will be understood that FIG. 1 shows one exemplary embodiment of a shared manifold trunk line 24. In other embodiments, the inlet block 26 may be connected at a different points along the shared manifold trunk line, and may be configured with more or fewer outlets to the shared manifold trunk line 24. The shared manifold trunk line 24 may include other components such as tee connections and valves. Similarly, the manifold trunk line may include branch lines such as lines that are perpendicular to or parallel to other portions of the trunk line, and thus the fracturing manifold modules connected along these branch lines may be connected in a manner such that components of adjacent fracturing modules are located perpendicularly, parallel or opposed to each other.

Each of the fracturing manifold modules 22*a*-22*e* may include similar components or different components. In FIG. 1, the modules 22*a*-22*e* each include a flow control unit 30 providing an inlet 32, an outlet 34 and one or more control valves between the inlet 32 and the outlet 34, such as a remotely operated gate valve 36 and a manually operated gate valve 38. The control valves might alternatively be plug valves or other industry standard control valves. In FIG. 1, the inlet 32, outlet 34 and control valves 36, 38 are interconnected and axially aligned along an x-axis of the fracturing manifold module extending perpendicularly to the y-axis of the shared manifold trunk line 24. However, in other embodiments, the components of the flow control unit 30 may be interconnected and axially aligned along a z-axis (generally a vertical axis). The connections between the flow control unit components are shown as flange connections, although other industry standard connections may also be used. The inlet 32 is shown as a 4-way cross, and the outlet 34 is shown as a 6-way cross, although other industry standard inlets and outlets may be used, with more or fewer connections at each of the inlets and outlets. The outlet 34 provides for connection to one of the wellheads W, via one or more fluid conduits 35. Both the wellheads W and conduits 35 are shown schematically in FIG. 1, and may be varied in accordance with industry standards to meet the needs of a particular fracturing operation.

As described more fully below, each of the fracturing manifold modules 22*a*-22*e* (shown in greater detail as 22 in FIGS. 2-8) includes a transport skid 40 which supports the flow control unit 30. In some embodiments, more than one flow control unit may be supported on a single transport skid 40. For example, two or more parallel spaced flow control units may be provided on a single transport skid, with the inlets aligned along a common y-axis, or multiple flow control units may be provided on a single transport skid in which the inlet of the flow control units is shared, but the each flow control unit provides a separate outlet.

The transport skid 40 is adapted to be ground supported, and may include one or more height adjustable legs 42 for leveling purposes. Alternatively, in some embodiments, the height adjustment may be provided by a support frame for the flow control unit 30. The transport skid 40 and the flow control unit 30 are connected together to provide for rotation of the flow control unit relative to the transport skid in a generally horizontal x-y plane relative to the ground. For ease of explanation herein, the x, y, z cartesian co-ordinates as applied to the fracturing manifold module 22 and the shared manifold trunk line 24 are shown as an inset in FIG. 2. A y-axis (Y) of the fracturing manifold module 22 extends through the inlet 32 so as to be aligned with the y-axis of the shared manifold trunk line. An x-axis of the fracturing manifold module 22 extends perpendicularly to the y-axis in an x-y plane. The x-y plane is a plane which is generally horizontal relative to the ground, and may be envisaged as a generally horizontal plane extending through the inlet 32 (for aligned connection at the inlet 32), a generally horizontal plane extending through the outlet 34 (for aligned connection at the outlet 34) or a generally horizontal plane extending through a support frame for the flow control unit such that the flow control unit components have fixed movement with the frame (such as flow control unit frame 44 in FIG. 2, for aligned connection at the inlet 32 and/or the outlet 34). The z-axis is generally perpendicular to the x-y plane, and generally refers to a vertical direction (i.e., generally parallel to the z-axis). The rotation of the flow control unit 30 relative to the transport skid is shown as Rz in FIG. 2, and is about the z-axis perpendicular to the x-y plane. This rotation of the flow control unit 30 in the x-y plane relative to the transport skid provides for adjustable connection to the shared manifold trunk line 24 once the module 22 is landed with the inlet 32 positioned proximate to the connection to the shared manifold trunk line 24. In some embodiments, this rotation may provide for adjustable connection at the outlet 34 to the fracturing manifold system 10, for example via the fluid conduits 35 to one of the plurality of wellheads W.

Figure 2:
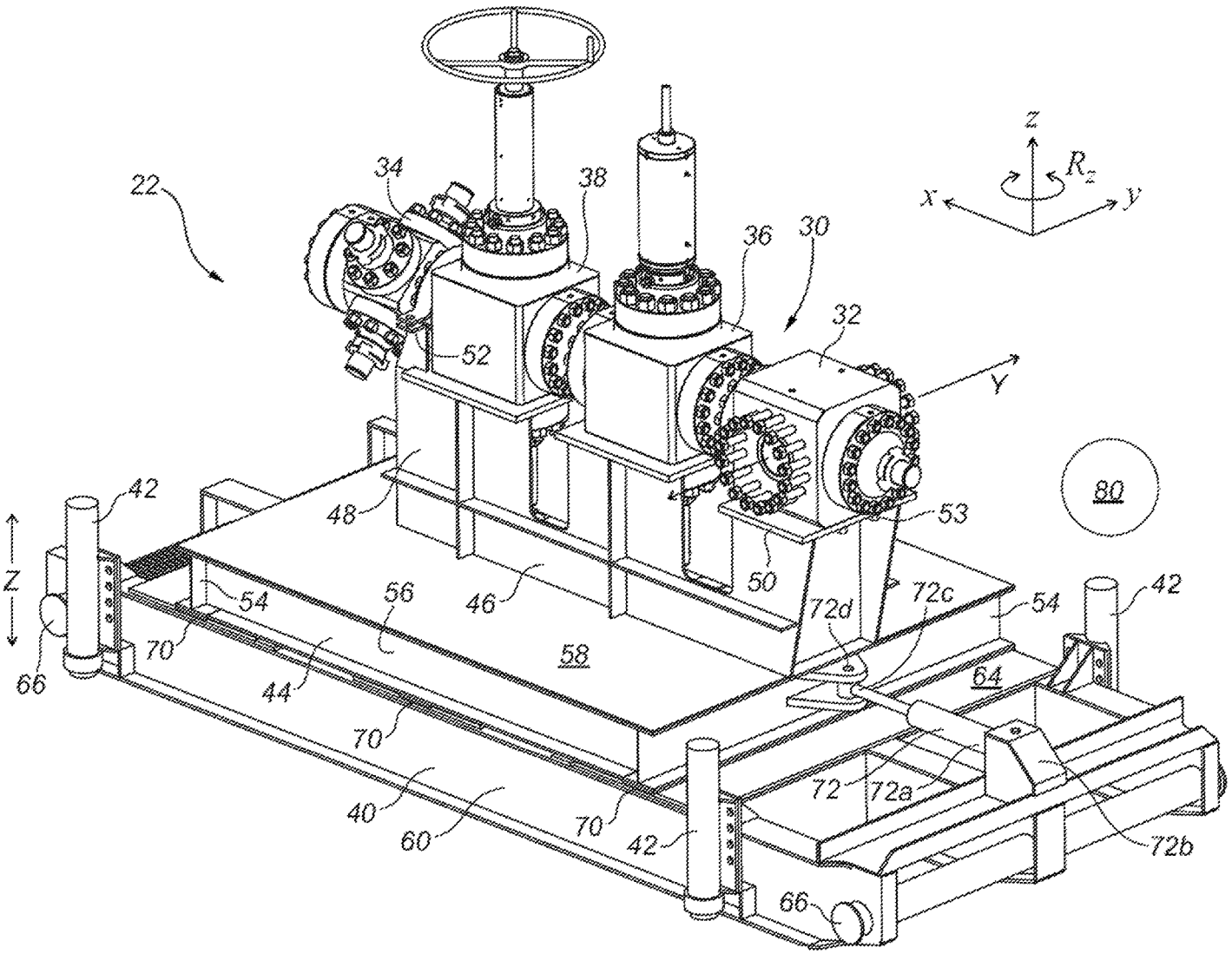

In the embodiments shown herein and described below, the transport skid 40 and the flow control unit 30 are also connected together to provide for translational movement of the flow control unit 30 relative to the transport skid 40 in the x-y plane. In FIG. 2, this relative translational movement is shown to be in the direction of both the y-axis and the x-axis of the fracturing manifold module 22 (i.e., separate translational movement in a direction generally parallel to the y-axis and in a direction generally parallel to the x-axis of the fracturing manifold module 22, with the y-axis being set to be parallel to the y-axis of the shared manifold trunk line 24). This relative translational movement provides for adjustable connection to the fracturing manifold system 20, for example to the shared manifold trunk line 24 at the inlet 32 and/or at the outlet 34 to the wellhead W through the fluid conduits 35. In the description which follows, this adjustable connection is described at the inlet 32 and along an aligned y-axis of the shared manifold trunk line 24. However, it will be understood that the adjustable connection can be made at the inlet 32, along a different axis of the shared manifold trunk line 24 that is not co-axial through the inlet 32, such as along an axis perpendicular to the y-axis with the inlet connections for the shared manifold trunk line 24 being at right angles through the inlet 32. It will also be understood that the adjustable connection can be made at the outlet 34. As used herein and in the claims when describing a connection at the inlet along an axis of the shared manifold trunk line, the axis refers to the center axis of the particular inlet connection to that portion of the shared manifold trunk line.

Fracturing Manifold Module

One exemplary embodiment of a fracturing manifold module 22 is shown in FIGS. 2-8. The flow control unit 30 is shown to be pedestal mounted on a flow control unit frame 44 for fixed movement with the frame 44, that is, as the frame 44 is moved in an x-y plane extending horizontally though the frame 44, each of the components of the inlet 32, outlet 34 and control valves 36, 38 have fixed movement with the frame 44. The flow control unit frame 44 is supported by the transport skid 40, which in turn is adapted to be ground supported. A pedestal frame 46 provides rigid vertical and horizontal supports 48, 50 secured to the flow control unit frame 44, elevating the components (32, 34, 36, 38) of the flow control unit 30 above the frame 44. The inlet 32, and control valves 36, 38 may be secured by bolting or other fasteners to the horizontal plate supports 50 of the pedestal frame 46 (inlet fasteners 53 are visible in FIG. 2), with the flange connections between the components 32, 34, 36 and 38 being axially aligned along an x-axis of the fracturing manifold module. The outlet 34 is shown to be additionally retained with a clamp connection 52 to secure the outlet 34 to the pedestal frame 46. The inlet 32 is shown as a 4-way cross, the outlet 34 is shown as a 6-way cross, and the control valves are shown as a remotely operated gate valve 36 and a manually operated gate valve 38. The components of the flow control unit 30 and their connections are industry standard and may be varied according with industry known standards. As noted above, in some embodiments, the flow control unit components may be axially aligned along a z-axis, so as extend in a vertical stack on the frame 44. In such embodiments, the inlet is commonly positioned at the bottom of the stack while the outlet is located at the top of the stack.

Figure 3:
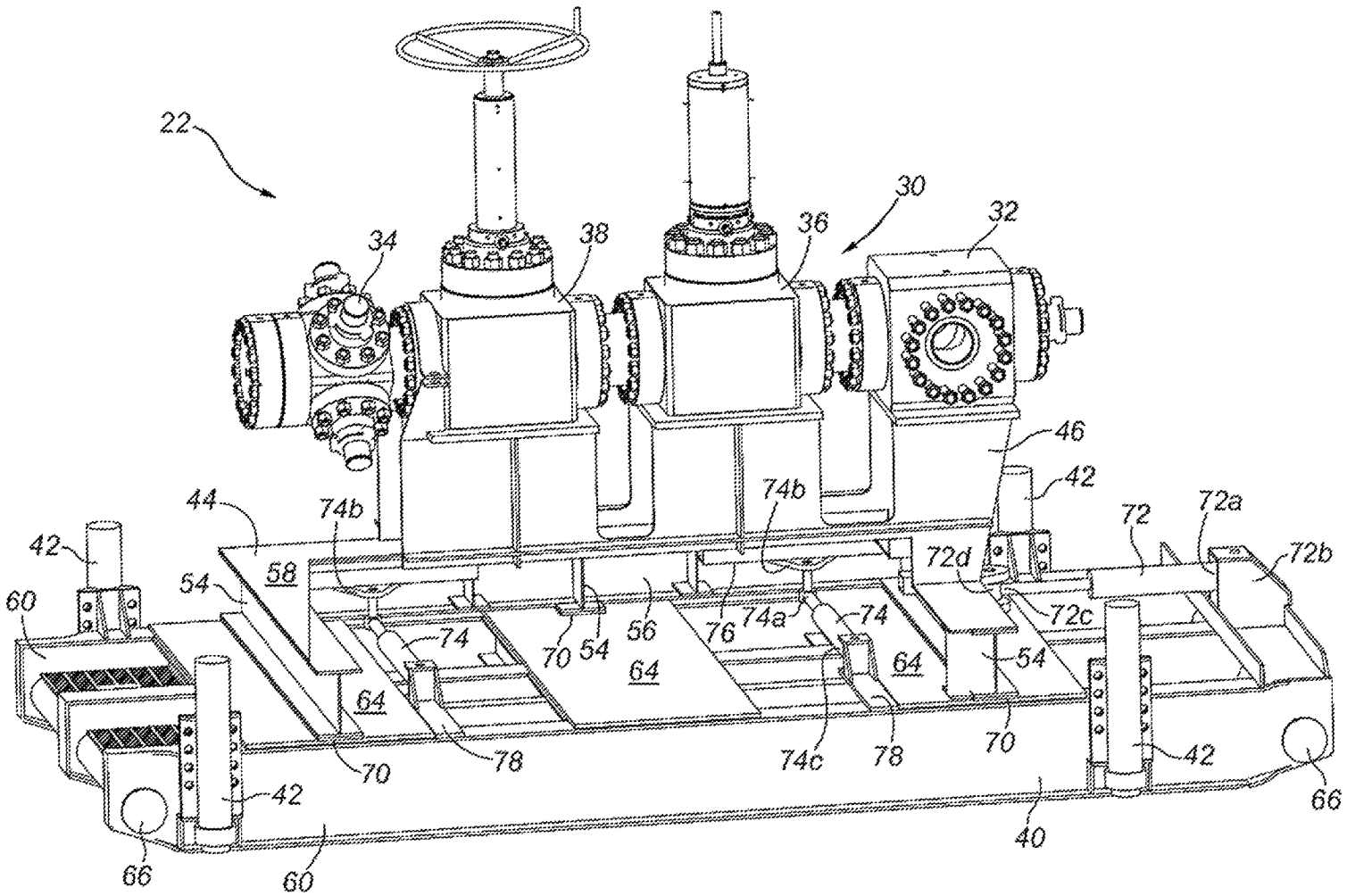

In FIGS. 2-3, the fracturing manifold module 22 is shown pre-assembled, in the locked mode for transport and landing. In FIG. 2, an inset of x, y and z coordinates of the fracturing manifold module 22 is included, with the y-axis being set to be parallel to the center y-axis of the shared manifold trunk line 24. With reference to these cartesian co-ordinates, the flow control unit frame 44 is shown to include a plurality of parallel spaced frame members 54 such as I-beams, extending in the direction of the y-axis of the module 22, and a pair of parallel spaced side frame members 56 such as I-beams, extending in the direction of the x-axis of the module 22, which combined form the rigid rectangular frame 44. A top plate 58 is connected along the top edges of the frame members 54, 56, and the pedestal frame 46 is rigidly connected, for example by welding and/or bolting, to the top plate 58 and frame members 54, 56.

The transport skid 40 includes a pair of parallel spaced skid frame members 60 such as I-beams (also known as runners), extending in the direction of the x-axis of the module 22, and parallel spaced cross members 62, such as I-beams extending transversely (i.e., in the direction of the y-axis of the module) between the skid frame members 60 to provide the generally rigid rectangular transport skid 40. Parallel spaced support plates 64 extend transversely between the upper edge portions of the skid frame members 60 above the transverse cross members 62. In FIG. 3, the cross members 62 are not visible, but extend below the support plates 64. Transport skid roll ends 66 extend through the skid frame members 60 at the front and rear corners of the transport skid 40 (front being at the inlet end) and extend outwardly from the skid frame members 60. These roll ends 66 provide for attachment to a crane for transport and landing, and/or for dragging the module 22 into a desired position. Additional structural frame members for the transport skid 40 and/or the flow control unit frame 44 may be included as appropriate to provide rigid frames to support the weight of the flow control unit 30, to withstand the relative movement between the frames, and to withstand vibration that may occur from the high pressure fracturing fluid.

Figure 4:
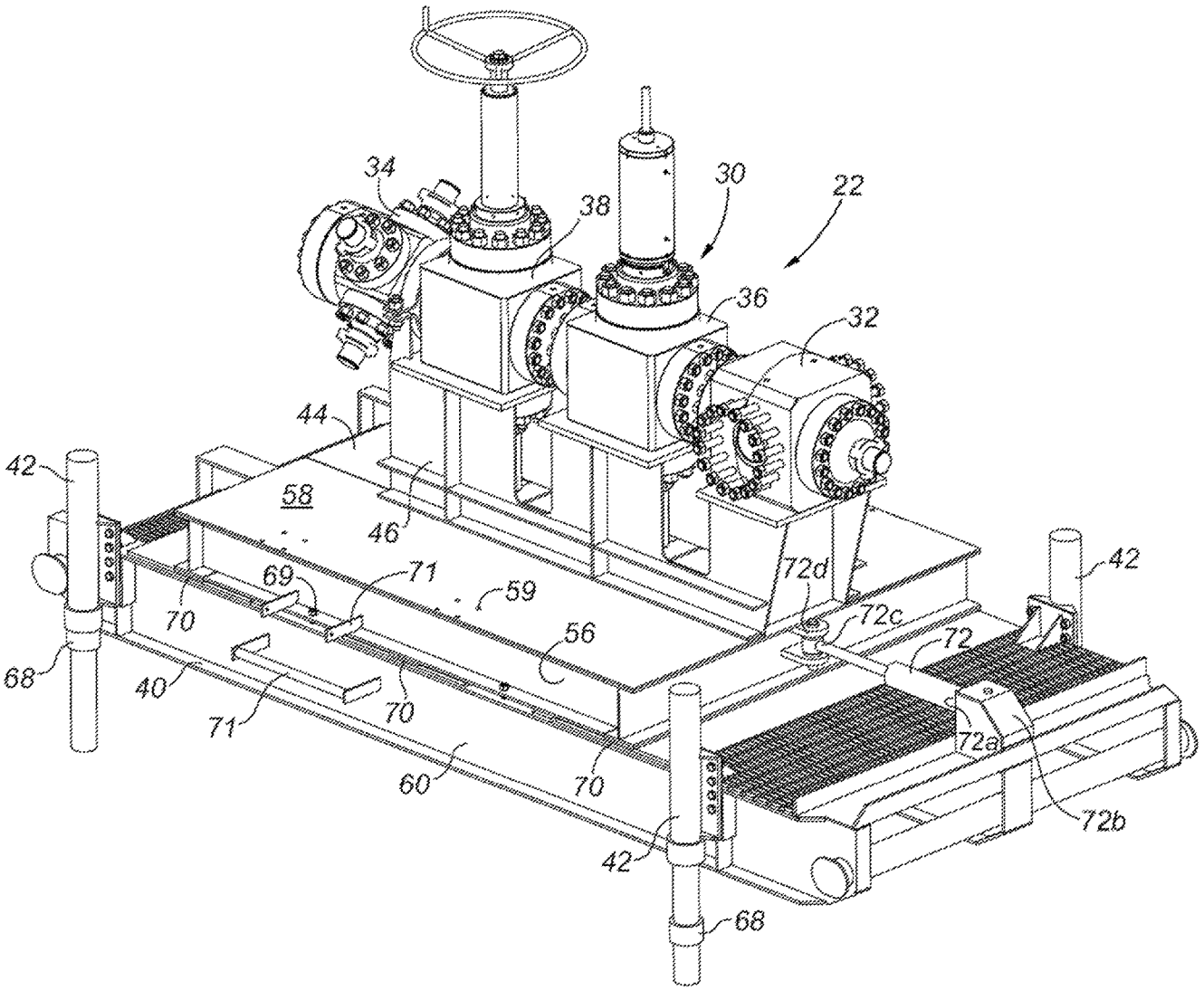

Also shown are a plurality (such as three or four) height adjustable legs 42 connected at the four corners of the transport skid 40, connected to the skid frame members 60. The legs 42 may be manual jacks, but due to the weight of the module, the legs 42 are more preferably independently controlled, actuated cylinders, such as hydraulic cylinders. Each leg 42 is preferably provided with a leg locking mechanism 68, such as a threaded ring lock, which can be threaded onto mating threads of the legs 42 once each leg 42 is height adjusted in order to lock the leg in position. FIG. 4 shows three of the four adjustable legs 42, with the leg 42 at the outlet end of the module 22 locked in position with the leg locking mechanism 68 against the cylinder portion of the adjustable leg 42, while the leg 42 at the inlet end of the module 22 is height adjusted with the leg locking mechanism 68 not yet in the locked position. Although not shown in the other Figures, once the module 22 is leveled and the legs 42 are locked, these leg locking mechanisms 68 remain in place on each leg 42. FIG. 4 also shows releasable locking devices 69 comprising bolted connections between the side members 56 of the flow control unit frame 44 and the skid frame members 60 of the transport skid. These releasable locking devices 69 are used to prevent relative movement during transport and landing of the fracturing manifold module 22. FIG. 4 also shows ladder rungs 71 to assist an operator in climbing to the top plate 58. Worker safety platform or railings and the like may be connected to the top plate 58 to operate and service the control valves 36, 38. Mounting holes 59 for a worker safety platform are shown in FIG. 4.

During pre-assembly of the fracturing manifold module 22, the flow control unit frame 44 is supported on the transport skid 40, with the lower edges of the parallel spaced frame members 54 supported on the support plates 64 of the transport skid 40. To reduce friction between the frame members, a friction reducing member 70 is provided at the one or more points of contact between the frame members 54, 64. In FIGS. 3-4, the friction reducing member 70 is shown as a sheet of a low friction material extending between the lower edges of the parallel spaced frame members 54 of the flow control unit frame 44 and the support plates 64 of the transport skid 40. Alternatively, this low friction material may be provided as shorter strips at these points of contact. Exemplary low friction materials include plastic and thermoplastic materials such as acetal, polycarbonate, PEEK, PTFE, UHMW, Nylon 6 Cast, Nylon 6/6 PVC and polypropylene. The friction reducing member 70 may alternatively be provided as a lubricant, or as a coating of a low friction material onto one or more of the frame members at the points of contact.

Figure 5:
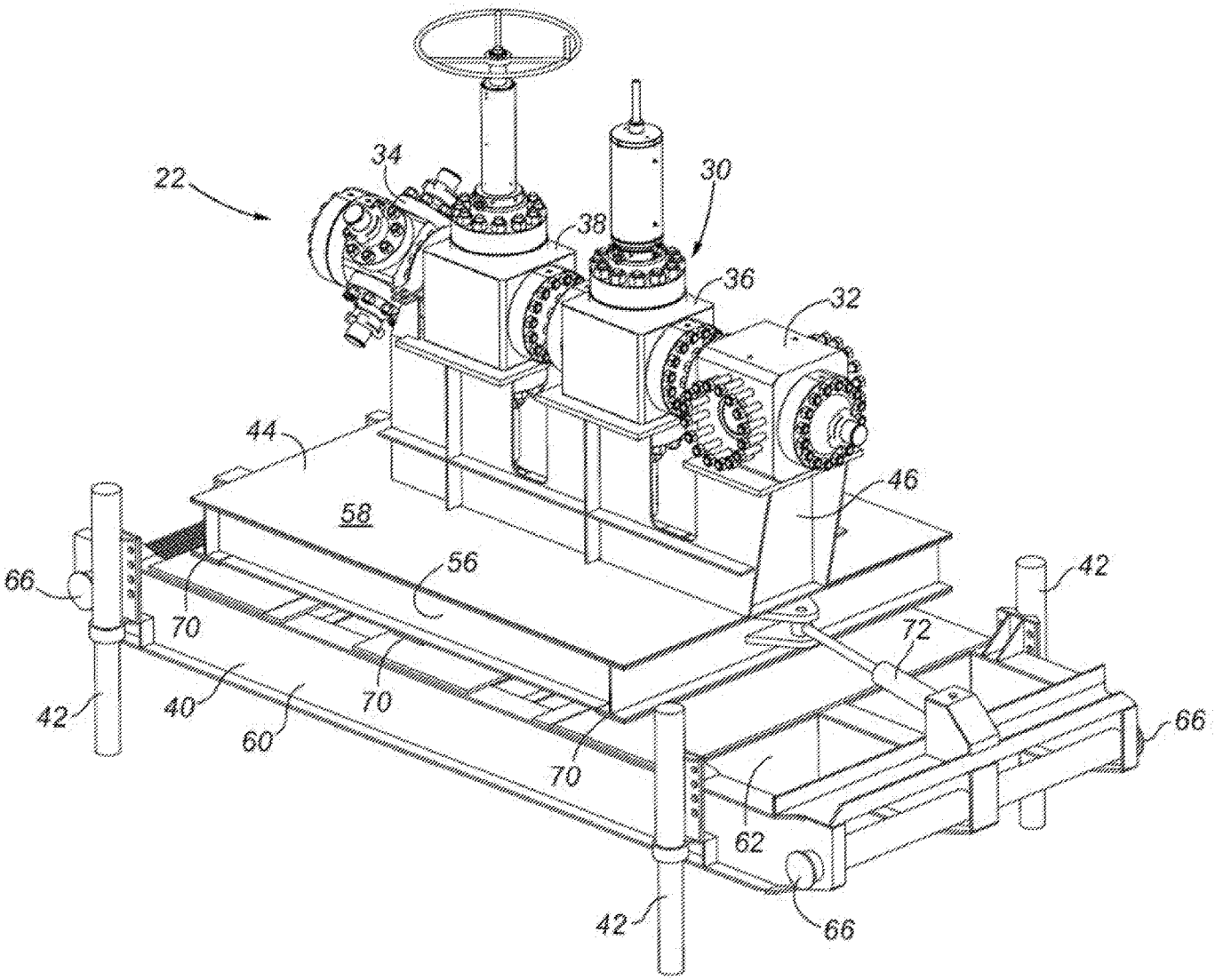
FIG. 5 is a perspective view of the fracturing manifold module of FIG. 2, illustrating relative translational movement of the flow control unit and frame relative to the transport frame in both the x and y directions to adjust the position of the inlet for connection along the y-axis of the shared fracturing manifold trunk line.
Figure 6:
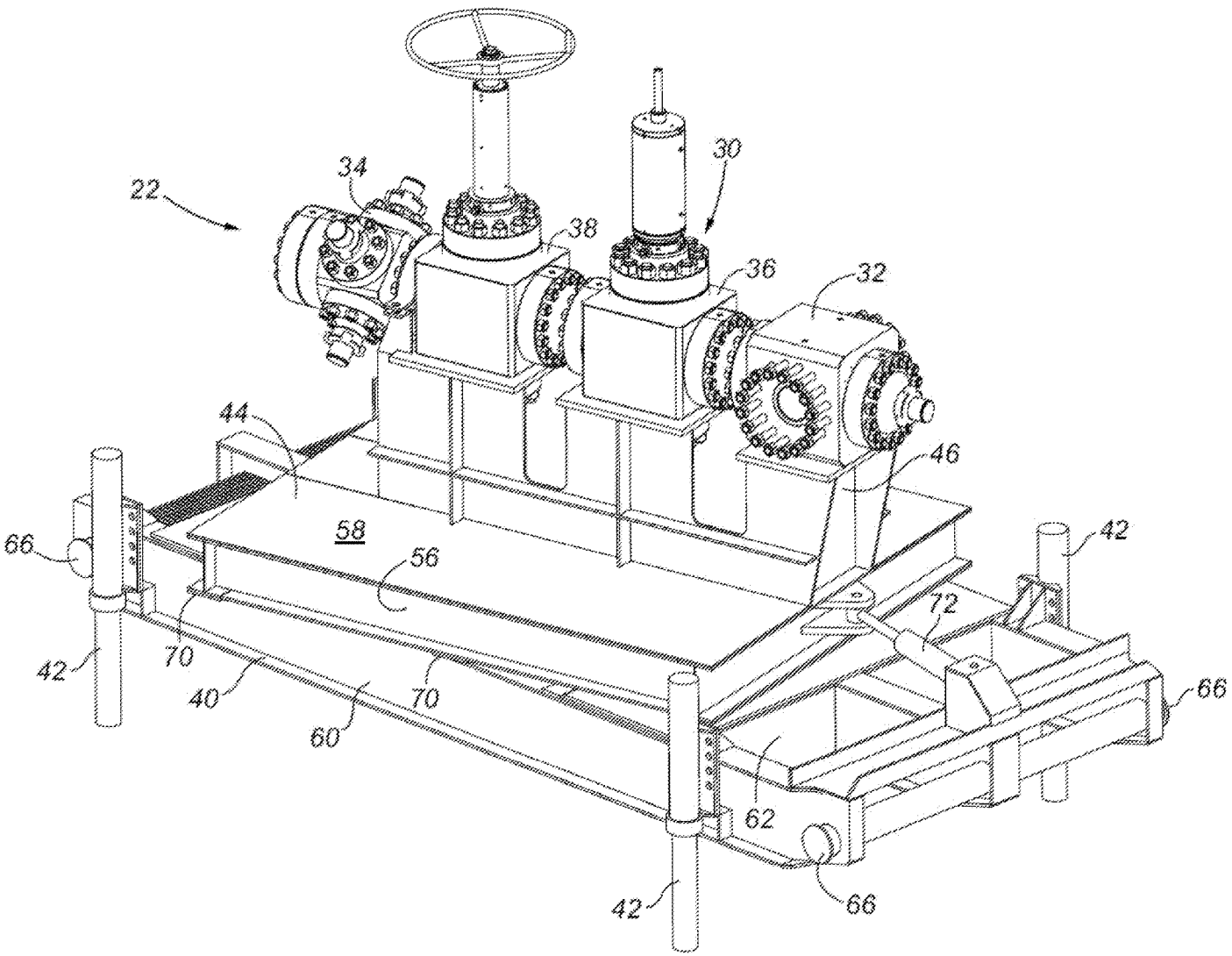
FIG. 6 is a perspective view of the fracturing manifold module of FIG. 2, illustrating rotation of the flow control unit and frame relative to the transport skid in the x-y plane relative to the ground and about the z-axis for adjustable connection along the y-axis of the shared manifold trunk line.
Figure 7:
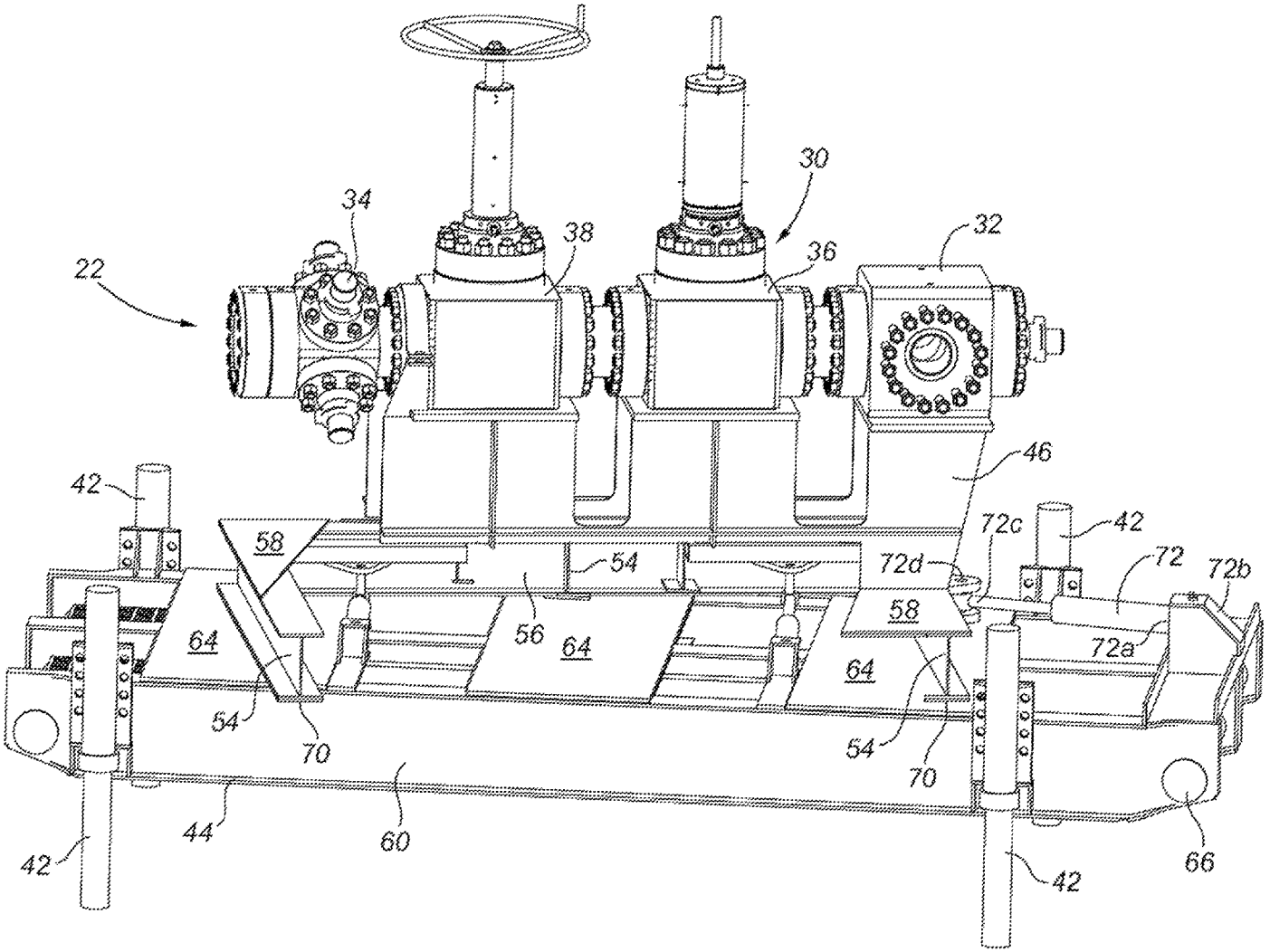
FIG. 7 is a side perspective view of the fracturing manifold module in the position of FIG. 6, with the flow control unit frame partially cut away.

In some embodiments, to provide the above-described relative rotational movement, and preferably also translational movement, between the transport skid 40 and the components of the flow control unit 30, to align the inlet 32 for connection to the shared manifold trunk line 24, the flow control unit frame 44 and the transport skid 40 are connected together by a plurality of independently controlled, actuated cylinders, such as pneumatic or hydraulic cylinders. In other embodiments, the plurality of cylinders might be replaced by manual actuators such as crank systems. As best seen in the cut away figures, FIGS. 3, 7 and 8, this relative movement is shown to provided by three, independently controlled, hydraulic cylinders, with one cylinder 72 extending in the direction of the x-axis of the manifold module 22, and two parallel spaced cylinders 74 extending in the direction of the y-axis of the manifold module. The x-axis directional cylinder 72 has its ends 72*a*, 72*c* pivotally connected to an upwardly extending mounting bracket 72*b* connected to the front end of the transport skid 40, and to a mounting bracket 72*d* connected to the front most frame member 54 of the flow control unit frame 44 (see FIG. 2). The x-axis directional cylinder 72 preferably extends parallel to a center axis of the manifold module 22, and generally horizontally in to the x-y plane. The y-axis directional cylinders 74 each have its ends 74*a*, 74*c* pivotally connected to a mounting bracket 74*b* attached to cylinder mounting beam 76 of the flow control unit frame 44 (see FIG. 8), and to a mounting bracket 74*d* attached to a cylinder mounting beam 78 of the transport skid (see FIGS. 3 and 8). The y-axis directional cylinders 74 are provided in spaces between the support plates 64 of the transport skid 40 so as not to interfere with the relative rotational and/or translational movement. The support plates 64 are sized to provide a supporting platform for the frame members 54 of the flow control unit frame 44 throughout the full range of the rotational and translational movement, as best shown in FIGS. 5-7. The y-axis directional cylinders 74 are preferably mounted to remain horizontal in the x-y plane. In other embodiments, the y-axis directional cylinders may be replaced with a single cylinder, and the x-axis directional cylinder may be replaced with a pair of parallel spaced cylinders. In other embodiments, additional cylinders might be provided, however, the provision of the three cylinders provides a simplicity of operation and hydraulic controls. The provision of the plurality of cylinders as described above, pivotally connected between the transport skid 40 and the flow control unit frame 44, allows for translational movement in the direction of either the x-axis or the y-axis of the flow control unit 30, and thus the inlet 32, by moving only the x-axis directional cylinder 72 or the y-axis directional cylinders 74 respectively. However, movement of both the x-axis directional cylinder and one or both of the y-axis directional cylinders 74 provides the relative rotation in the x-y plane about the z-axis, to provide for adjustable connection to the shared manifold trunk line 24 at the inlet 32.

A hydraulic control system 80 is shown schematically in FIG. 2 for operation of the adjustable legs 42 and cylinders 72, 74. The hydraulic control system 80 includes appropriate control valves to extend and retract the hydraulic cylinders 72 and 74. The control system provides hydraulic locking of the cylinders 72, 74 against further relative movement after aligning the inlet 32 for connection to the shared manifold trunk line 24. The hydraulic locking mechanism for the cylinders 72, 74 includes check valves in the hydraulic lines beyond the hydraulic control valves, to lock the cylinders 72, 74 in place. Similar controls and locking are provided for each of the adjustable legs 42 to lock the legs 42 after leveling.

In the event of settling of the transport skid 40, or if other minor adjustments are needed, one or more of the locking systems for the adjustable legs 42 and cylinders 72, 74 can be unlocked (with unlocking of the leg locking mechanism 68), to allow for further adjustments to the position of the inlet 32 or outlet 34 with cylinders 42, 72 and/or 74, and then the adjustable legs 42, leg locking mechanism 68, and hydraulic cylinders 72, 74 are re-locked.

Operation

Operation of the fracturing system 10 according to one or more embodiments will now be described. A plurality of fracturing manifold modules 22 are pre-assembled as needed for a particular configuration of a fracturing system 10, the pre-assembly being repeated for each manifold module 22. The flow control unit 30, is pre-assembled prior to connecting to the pedestal frame 46 of the flow control unit frame 44. As above, each flow control unit 30 generally includes an inlet 32, two flow control valves 36, 38 and an outlet 34. The inlet 32 is commonly a 4-way cross. The flow control valves 36, 38 are commonly gate valves, one remote operation, one manual operation. The outlet 34 has connections for one or more fluid conduits 35, with the figures showing a 6-way cross. In general, a 6-way cross outlet 34 provides for a total of five fluid conduit connections. Two 6-way cross outlets 34 provide for nine fluid conduit connections. Still alternatively, the outlet may provide for more or fewer fluid conduit connections, such as a single fluid conduit. This varies with the particular fracturing operation, required fracturing rates, and the inlet block 26 configuration to the shared manifold trunk line 24. As above, the components of the flow control unit 30, the inlet block 26, the components of the shared manifold trunk line 24 and the connections throughout the fracturing manifold system 20 may be varied as appropriate for a particular fracturing operation and in view of the layout of a particular well pad fracturing operation.

The shared manifold trunk line 24 typically has a uniform bore size, such as a 7⅟₁₆" bore, although a different bore size may be specified, such as a 5⅛" bore. This 7⅟₁₆" bore is generally consistent through the shared manifold trunk line 24, and through each component (32, 34, 36, 38) of the flow control unit 30.

The outlet 34, as shown, with multiple fluid conduit connections 35, is generally prepared for common frac iron being 3" (2.75" or other bore size) or 4" (3.50, 3.75" or other bore size). Alternatively, an outlet with a single fluid conduit connection may match the 7⅟₁₆" bore in the flow control unit 30 or a reduced bore such as 5⅛". Other inlet and outlet configurations and connections may be provided as appropriate.

The shared manifold trunk line 24 has a single inlet block or multiple inlet blocks 26 adapted to receive high pressure fracturing fluids through one or more fluid conduits 27 from the high-pressure stimulation services S. FIG. 1 shows two inlet blocks 26 providing a total of eight fluid conduit connections, with each inlet block 26 having four fluid conduit connections. These fluid conduits 27 are generally prepared for 3" frac iron (2.75" or other bore size) or 4" frac iron (3.50", 3.75" or other bore size). Alternatively, an inlet block 26 may be provided with a 4-way cross, similar to the inlet 32 no the individual flow control units 30. The inlet block 26 with one fluid conduit may match the 7⅟₁₆" bore of the shared manifold trunk line or a 5⅛" bore, for example.

The flow control unit 30 is pedestal mounted in the pockets provided by the horizontal pedestal support plates 50. The pockets provide recesses for the control valves 36, 38. The inlet 32 and control valves 36, 38 are bolted and/or welded in place. For retaining the flow control unit 30 to the pedestal frame 46, the clamp connection 52 is fastened on the flange of the outlet 34, and inlet fasteners 53 secure the inlet 32 to the horizontal plate 50 of the pedestal frame 46.

The flow control unit 30 is mounted for fixed movement with the flow control unit frame 44, which in turn is supported on the transport skid 40, with the friction reducing members 70 in place, and the hydraulic cylinders 72 and 74 pivotally connected between the flow control unit frame 44 and the transport skid 40 as described above. This pre-assembled fracturing manifold module 22 is then ready for road transport to the well pad.

In the transport (home) position of the fracturing manifold module 22 shown in FIGS. 1-3, the four height adjustable legs 42 (hydraulic cylinders) of the transport skid 40 are fully retracted, such that the skid frame members 60 are on the ground. The leg locking mechanisms 68 are not yet in place on the four adjustable legs 42 in this transport position.

The flow control unit frame 44 is adjusted relative to the transport skid 40 with the three hydraulic cylinders 72, 74 to place the flow control unit frame 44 in the transport position. In this position the releasable locking devices 69 are installed and mechanically lock the flow control unit frame 44 to the transport skid 40. The releasable locking mechanism of the hydraulic control system locks the hydraulic cylinders 72, 74 against relative movement, and also locks adjustable legs 42 against movement. In the transport position, the hydraulic cylinders 72, 74 are generally in the midpoint position for the extension and retraction of the three hydraulic cylinders, i.e. there is equal translational movement in the x direction of the one cylinder, and equal translational movement in the y direction for the other cylinders, in the transport position.

The four skid roll ends 66 are used for lifting the fracturing control module 22 by a high capacity crane, or two of the skid roll ends 66 are used with a winch-tractor or bed-truck for transporting and/or initial landing placement of the fracturing manifold module 22, i.e, in the direction of the x-axis of the fracturing module 22.

On location, rough measurements are made for initial placement of the fracturing manifold module(s) 22. There is consideration to the grade for movement in the z direction for each fracturing manifold module 22.

The number of fracturing manifold modules 22 generally corresponds to the number of wells being stimulated through fracturing wellheads W. The inlet block(s) 26 of the shared manifold trunk line 24 receive the high pressure fracturing fluid through one or more fluid conduits 27 from the stimulation services S and distribute to the shared manifold trunk line 24 for all modules 22. Placement of the inlet block(s) 26 can be at either end of the outermost modules (ex. 22*a*, 22*e*), or between any two modules (ex. between 22*b* and 22*c* as in FIG. 1).

The shared manifold trunk line 24 includes spacer spools 28 of frac iron between inlets 32 of the fracturing manifold modules 22. Spacer spools 28 are standard length, in foot increment lengths, from approximately 2 feet to 12 feet. Spacer spools 28 may be provided in non-standard lengths. Connections of the spacer spools 28 are typically industry standard flanges with pressure-energized metal seal ring gaskets. These connections are also standard for the components of the flow control units 30. Spacer spools 28, flow control unit inlets 32, and inlet blocks 26 may be provided with other industry standard connections, for example clamp-end hub connections with pressure energized metal seals.

Outrigger pads may be provided for the adjustable legs 42 on the transport skid 40, reducing the need for additional specifications to the end user to prepare the grade and surface on location. The allotted footprint on location and proximity to wellheads determines the placement of the fracturing manifold modules 22, the inlet block 26 and number of spacer spools 28 required between subsequent modules 22. Distances are known from one fracturing manifold module 22 to the next (i.e., adjacent fracturing manifold modules 22) depending on the length of spacer spools 28 on each section of the shared manifold trunk line 24. The location of the first fracturing manifold module 22 is determined with consideration to the corresponding well and the allotted footprint for all modules 22. Due to the adjustability provided in each of the fracturing manifold modules 22, only minor consideration is needed for the x-y plane of the first module 22. The high capacity crane lifts and lands the fracturing module 22 by the four roll ends 66 such that inlet is proximate to the location for connecting along the y-axis of the shared manifold trunk line 24. As above, this initial placement may be set for the outlet connections, but the inlet connections more commonly set the position for the first module 22. Alternatively, if space permits, the module 22 may be landed with a bed truck or winch tractor or other equipment, using two skid roll ends 66 on the transport skid 40 and moving the module 22 in the general x-direction (relative to the y-axis of the shared manifold trunk line 24), with the skid frame members 60 sliding on location for proximate placement.

From the known distances each remaining fracturing manifold module 22 is placed with previous consideration to the y-axis of the shared manifold trunk line 24 (or the outlet position in some cases). The high capacity crane is not further needed for making up the connections at the inlet 32 along the shared manifold trunk line 24 or at the outlet 34.

Once all fracturing manifold modules 22 are located, outrigger pads may be placed under each adjustable leg 42 of the first module 22. The adjustable legs 42 are raised in the direction of the z-axis to level the flow control unit 30 (and the flow control unit frame 44 and inlet 32), such that the x-y plane of the inlet 32 of the flow control unit 30 (in general this is parallel to the x-y plane of the flow control unit frame 44) is generally horizontal and parallel to the ground. The hydraulic system locks all adjustable legs 42 during leveling and then the leg locking mechanisms 68 are placed on all four adjustable legs 42.

Figure 8:
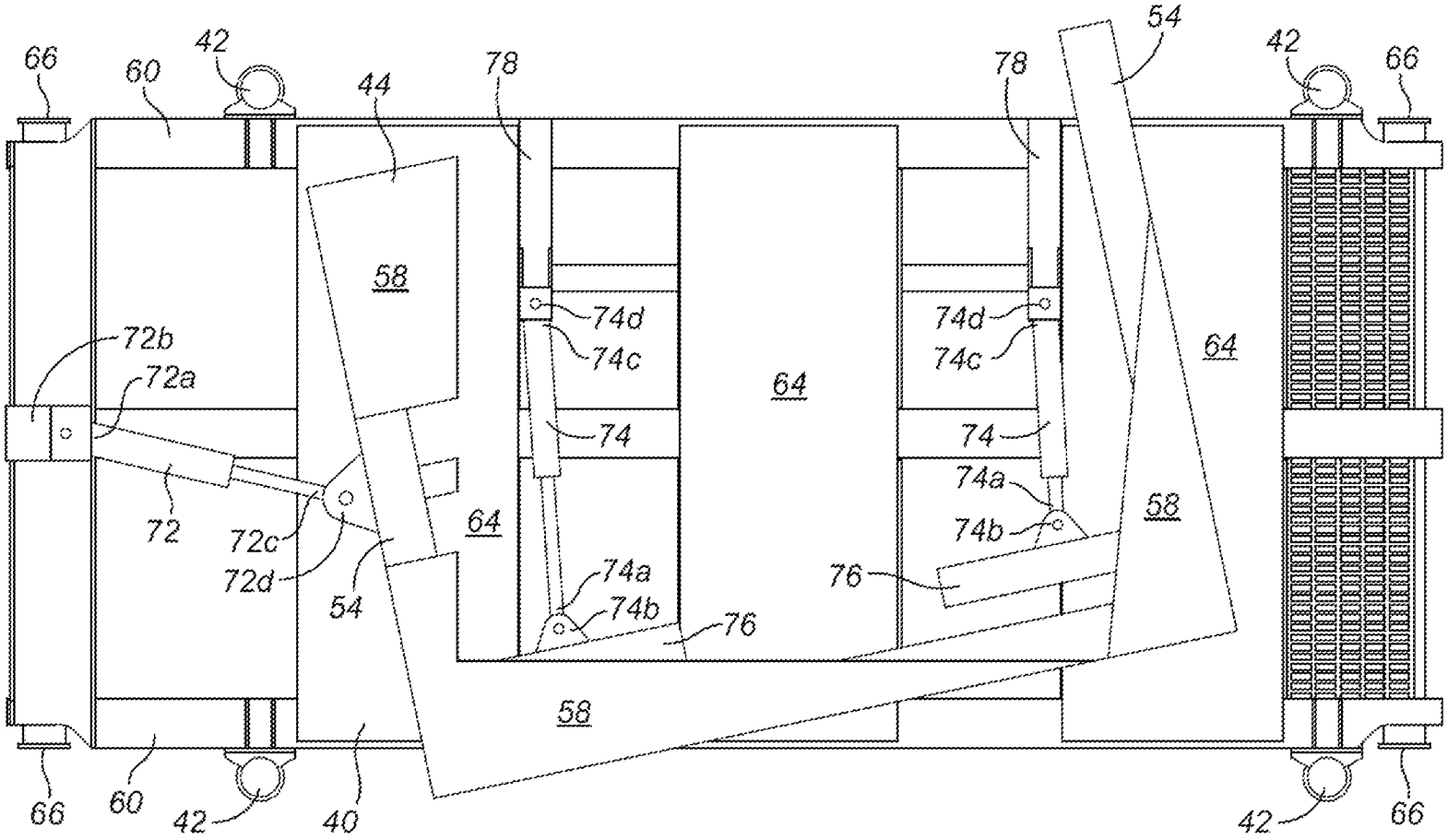
FIG. 8 is a top view of the fracturing manifold module of FIG. 6, but with the flow control unit components and pedestal mounts removed and the flow control unit frame partially cut away.

The releasable locking devices 69 are removed between the transport skid 40 and the flow control unit frame 44. As required, the three hydraulic cylinders 72, 74 are operated to adjust the position of the inlet and the outlet in x-y plane of the frame 44 by rotating the flow control unit frame 44 relative to the stationary transport skid 40. This adjusts the position of the inlet 32 and the outlet 34 in the x-y plane about the z-axis (Rz in FIG. 2). This relative rotational movement is shown in FIGS. 6-8. The hydraulic cylinders 72 and/or 74 may also be adjusted in the direction of the x-axis and the y-axis with relative translational movement to align the inlet 32 for connection with the y-axis of the shared manifold trunk line 24 (see FIG. 5), although for the first module 22, this may not be needed, depending on the initial placement. After alignment and connection at the inlet 32, hydraulic controls for the x and y-directional cylinders 72, 74 lock the cylinders 72, 74 against further relative movement between the transport skid 40 and the flow control unit frame 44.

On the second (next adjacent) fracturing manifold module 22, the outrigger pads are placed beneath the adjustable legs 42 and the releasable locking devices 69 are removed between the transport skid 40 and the flow control unit frame 44. The adjustable legs 42 are operated to level the frame 44 relative to the ground and to provide for proximity at the inlet 32 to the y-axis of shared manifold trunk line. The three cylinders 72, 74 are operated to establish the x-y plane rotated on the z-axis to have the inlet y-axis coaxial with the shared manifold trunk line 24 (as above). The two hydraulic cylinders in the y-direction 74 may be adjusted to assist making up the spacer spools 28. After spacer spools 28 connections are made-up, the four leg locking mechanisms 68 are placed on the adjustable legs 42, and the hydraulic controls lock the cylinders 72, 74 and adjustable legs 42 against further movement. Alternatively, as noted above, this second fracturing manifold module 22 may be aligned for connections at the outlet 34.

This process is repeated for the remaining fracturing manifold modules.

During stimulation, the leg locking mechanisms 68 are inspected. If required, for example due to settling, the hydraulic locks for adjustable legs 42 and the leg locking mechanisms 68 are unlocked, the adjustable legs 42 are operated to level at the inlet 32 and/or at the outlet 34, and the hydraulic controls and the leg locking mechanisms 68 are reset. If needed, the hydraulic cylinders 72, 74 may be unlocked for fine adjustments at the inlet 32 and/or the outlet 34. After any adjustment, the hydraulic controls are relocked and the leg locking mechanism 68 are reset.

As used herein and in the claims, the word "comprising" is used in its non-limiting sense to mean that items following the word in the sentence are included and that items not specifically mentioned are not excluded. The use of the indefinite article "a" in the claims before an element means that one of the elements is specified, but does not specifically exclude others of the elements being present, unless the context clearly requires that there be one and only one of the elements.

All references mentioned in this specification are indicative of the level of skill in the art of this invention. All references are herein incorporated by reference in their entirety to the same extent as if each reference was specifically and individually indicated to be incorporated by reference. However, if any inconsistency arises between a cited reference and the present disclosure, the present disclosure takes precedence. Some references provided herein are incorporated by reference herein to provide details concerning the state of the art prior to the filing of this application, other references may be cited to provide additional or alternative device elements, additional or alternative materials, additional or alternative methods of analysis or application of the invention.

The terms and expressions used are, unless otherwise defined herein, used as terms of description and not limitation. There is no intention, in using such terms and expressions, of excluding equivalents of the features illustrated and described, it being recognized that the scope of the invention is defined and limited only by the claims which follow. Although the description herein contains many specifics, these should not be construed as limiting the scope of the invention, but as merely providing illustrations of some of the embodiments of the invention.

One of ordinary skill in the art will appreciate that elements and materials other than those specifically exemplified can be employed in the practice of the invention without resort to undue experimentation. All art-known functional equivalents, of any such elements and materials are intended to be included in this invention. The invention illustratively described herein suitably may be practised in the absence of any element or elements, limitation or limitations which is not specifically disclosed herein.

We claim:

1. A fracturing manifold module of a fracturing manifold system for controlling the flow of fracturing fluid from a shared manifold trunk line to a plurality of wellheads each adapted for fracturing a well, the fracturing manifold module comprising:

a transport skid adapted to be ground supported;

a flow control unit supported on the transport skid and including an inlet adapted for connection to the shared manifold trunk line along an axis of the shared manifold trunk line, an outlet adapted for connection to one of the plurality of wellheads via one or more fluid conduits, and one or more flow control valves between the inlet and the outlet such that the inlet, the outlet and the one or more flow control valves of the flow control unit are interconnected; and the transport skid and the flow control unit being connected together to provide for rotation of the flow control unit relative to the transport skid in a generally horizontal x-y plane relative to the ground, said rotation being about a z-axis perpendicular to the x-y plane to provide for adjustable connection to the fracturing manifold system at one or both of the inlet and the outlet.

2. The fracturing manifold module of claim 1, wherein the transport skid and the flow control unit are connected together to provide for translational movement of the flow control unit relative to the transport skid in the x-y plane to provide for adjustable connection to the fracturing manifold system at one or both of the inlet and the outlet.

3. The fracturing manifold module of claim 2, wherein the rotation about the z-axis and the translational movement of the flow control unit in the x-y plane relative to the transport skid are provided by a plurality of independently controlled, actuated cylinders.

4. The fracturing manifold module of claim 3, wherein:

the transport skid and the flow control unit are adapted to provide for height adjustment along the z-axis to level the flow control unit relative to the ground and to provide for adjustable connection to the fracturing manifold system at one or both of the inlet and the outlet.

5. The fracturing manifold module of claim 4, wherein:

the flow control unit is connected to a flow control unit frame for fixed movement therewith while the transport skid remains ground supported and stationary; and the flow control unit frame is supported on the transport skid and is connected to the transport skid through the plurality of cylinders to provide the rotation and the translational movement relative to the transport skid.

6. The fracturing manifold module of claim 5, wherein the plurality of cylinders includes three or more independently controlled, actuated cylinders, each of which is pivotally connected between the transport skid and the flow control unit frame.

7. The fracturing manifold module of claim 6, wherein;

the inlet is adapted for connection along a y-axis of the shared manifold trunk line;

the three or more independently controlled, actuated cylinders include at least one cylinder oriented to provide the translational movement in the direction of either an x-axis or a y-axis of the fracturing manifold module, wherein the y-axis is adapted to extend parallel to the y-axis of the shared manifold trunk line, and the x-axis extends perpendicularly to the y-axis of the of the fracturing manifold module in the x-y plane, and at least two cylinders oriented to provide the translational movement in the direction of the other of the x-axis or the y-axis, such that movement of both an x-axis directional cylinder and a y-axis directional cylinder provides the rotation about the z-axis.

8. The fracturing manifold module of claim 7, wherein the three or more cylinders include three cylinders.

9. The fracturing manifold module of claim 8, wherein each of the three cylinders is a hydraulic cylinder.

10. The fracturing manifold module of claim 9, further comprising a releasable locking mechanism such that, in a locked position, the rotation and the translational movement are prevented.

11. The fracturing manifold module of claim 10, wherein the releasable locking mechanism is included in a hydraulic system controlling the three or more cylinders.

12. The fracturing manifold module of claim 7, wherein the transport skid includes one or more height adjustable legs to provide the height adjustment along the z-axis.

13. The fracturing manifold module of claim 11, wherein the transport skid includes four height adjustable legs to provide the height adjustment along the z-axis, each adjustable leg being hydraulically controlled, and each adjustable leg having a leg locking mechanism to lock the position of the leg after any adjustment.

14. The fracturing manifold module of claim 7, wherein the inlet is positioned on the flow control frame for connection along the y-axis to the shared manifold trunk line, and the inlet and the outlet are positioned on the flow control unit frame aligned one with the other either along the x-axis or along the z-axis of the fracturing manifold module.

15. The fracturing manifold module of claim 13, wherein the inlet is positioned on the flow control frame for connection along the y-axis to the shared manifold trunk line, and the inlet and the outlet are positioned on the flow control unit frame aligned one with the other along the x-axis of the fracturing manifold module.

16. The fracturing manifold module of claim 15, wherein the flow control unit includes two control valves, one adapted for remote operation and one adapted for manual operation, and wherein the inlet, the outlet and the two control valves are pedestal mounted on the flow control unit frame for fixed movement therewith.

17. The fracturing manifold module of claim 16, wherein each of the control valves is a gate valve or a plug valve.

18. The fracturing manifold module of claim 7, further comprising a friction reducing member at one or more points of contact between the transport skid and the flow control unit frame to assist in the rotation and the translational movement.

19. The fracturing manifold module of claim 18, wherein the friction reducing member is one or more of a lubricant, a coating of a friction reducing material, and a strip or a sheet of a low friction material.

20. The fracturing manifold module of claim 18, wherein the friction reducing member is a strip or a sheet of a low friction material.

21. The fracturing manifold module of claim 17, wherein:

the transport skid includes parallel spaced skid frame members, and parallel spaced support plates extending transversely between an upper edge portion of the skid frame members;

the flow control unit frame includes parallel spaced frame members, a lower edge portion of each of the frame members of the flow control unit frame being supported on one of the support plates of the transport skid;

a friction reducing member comprising a strip or a sheet of a low friction material is provided at one or more points of contact between the frame member of the flow control unit frame and the support plates of the transport skid to assist in the rotation and the translational movement between the transport skid and the flow control unit frame; and the flow control unit, the flow control unit frame, the transport skid, the plurality of cylinders, the height adjustable legs and the friction reducing member are pre-assembled as a transportable module.

22. The fracturing manifold module of claim 21, wherein:

for the translational movement in the direction of the x-axis, the transport skid is connected to the flow control unit frame by the x-axis directional hydraulic cylinder pivotally connected between one of the frame members of the flow control unit frame and the transport skid; and for the translational movement in the direction of the y-axis, the transport skid is connected to the flow control unit frame by a pair of the y-axis directional hydraulic cylinders, each being pivotally connected between one of the skid frame members and one of the frame members of the flow control unit; and actuation of the x-axis directional hydraulic cylinder and one or both of the y-axis directional hydraulic cylinders provides the rotational movement about the z-axis.

23. The fracturing manifold module of claim 5, further comprising one or more releasable locking devices interconnecting the transport skid and the flow control unit frame to prevent any relative movement during transport and landing of the fracturing manifold module.

24. The fracturing manifold module of claim 5, comprising two or more flow control units mounted on the flow control unit frame, wherein the inlets of each of the two or more flow control units are aligned along the y-axis for connection along the y-axis of the shared manifold trunk line, or wherein the two or more flow control units have a shared inlet.

25. The fracturing manifold module of claim 1, wherein the inlet and the outlet are axially aligned one with another.

26. A fracturing system for controlling the flow of fracturing fluid to a plurality of wellheads, each adapted for fracturing a well, the fracturing system comprising:

a fracturing manifold system connected to the plurality of wellheads for delivering fracturing fluid to the plurality of wellheads, the fracturing manifold system including a shared manifold trunk line and a plurality of fracturing manifold modules connected to the shared manifold trunk line for controlling the flow of the fracturing fluid from the shared manifold trunk line to one of the plurality of wellheads;

each of the fracturing manifold modules including:

a transport skid adapted to be ground supported;

a flow control unit supported on the transport skid and including an inlet adapted for connection along an axis of the shared manifold trunk line, an outlet adapted for connection to one of the plurality of wellheads via one or more fluid conduits, and one or more flow control valves between the inlet and the outlet such that the inlet, the outlet and the one or more flow control valves of the flow control unit are interconnected; and the transport skid and the flow control unit being connected together for rotation of the flow control unit relative to the transport skid in a generally horizontal x-y plane relative to the ground, said rotation being about a z-axis perpendicular to the x-y plane to provide for adjustable connection to the fracturing manifold system at one or both of the inlet and the outlet.

27. The fracturing system of claim 26, wherein the inlet and the outlet are axially aligned one with another.

28. A method of aligning a fracturing manifold module for connection to a shared manifold trunk line of a fracturing manifold system, comprising:

providing a flow control unit, the flow control unit including an inlet adapted for connection along an axis of the shared manifold trunk line, an outlet adapted for connection to one of a plurality of wellheads via one or more fluid conduits, and one or more flow control valves between the inlet and the outlet such that the inlet, the outlet and the one or more flow control valves of the flow control unit are interconnected;

supporting the flow control unit on a transport skid adapted to be ground supported, the flow control unit and the transport skid being connected together to provide for rotation of the flow control unit relative to the transport skid in a generally horizontal x-y plane relative to the ground, said rotation being about a z-axis perpendicular to the x-y plane;

landing the transport skid and flow control unit for proximity to the shared manifold trunk line and to one of the plurality of wellheads; and adjusting the position of the flow control unit by rotating the flow control unit relative to the transport skid in the x-y plane about the z-axis to align one or both of the inlet and the outlet for connection to the fracturing manifold system.

29. The method of claim 28, wherein the inlet and the outlet are axially aligned one with another.

30. The method of claim 28, wherein:

the transport skid and the flow control unit are connected together to provide for translational movement of the flow control unit relative to the transport skid in the x-y plane, and the adjusting step further includes translating the flow control unit relative to the transport skid in the x-y plane to align one or both of the inlet and the outlet for connection to the fracturing manifold system.

31. The method of claim 30, further comprising, landing the transport skid and the flow control unit such that the transport skid is ground supported, and leveling the flow control unit in the x-y plane relative to the ground by adjusting the height of the flow control unit.

32. The method of claim 31, wherein:

the flow control unit is connected to a flow control unit frame for fixed movement therewith while the transport skid remains ground supported and stationary;

the flow control unit frame is supported on the transport skid and is connected to the transport skid through a plurality of independently controlled, actuated cylinders to provide the rotation about the z-axis and the translational movement of the flow control unit relative to the transport skid in the x-y plane; and the adjusting step includes actuating the plurality of cylinders to rotate the flow control unit frame about the z-axis and to translate the flow control unit frame in the x-y plane relative to the transport skid.

33. The method of claim 32, wherein the plurality of cylinders includes three or more independently controlled, actuated cylinders, each of which is pivotally connected between the transport skid and the flow control unit frame.

34. The method of claim 33, wherein:

the inlet is adapted for connection along a y-axis of the shared manifold trunk line;

the transport skid and the flow control unit are landed such that the inlet is proximate to the y-axis of the shared manifold trunk line and the adjusting step includes aligning the inlet for connection to the shared manifold trunk line with the inlet aligned along the y-axis of the shared manifold trunk line; and the three or more independently controlled, actuated cylinders include at least one cylinder oriented to provide the translational movement in the direction of either an x-axis or a y-axis of the fracturing manifold module, wherein the y-axis is adapted to extend parallel to the y-axis of the shared manifold trunk line, and the x-axis extends perpendicularly to the y-axis of the of the fracturing manifold module in the x-y plane, and at least two cylinders oriented to provide the translational movement in the direction of the other of the x-axis or the y-axis, such that the adjusting step includes actuating both an x-axis directional cylinder and a y-axis directional cylinder to provide the rotation about the z-axis.

35. The method of claim 34, wherein the three or more independently controlled, actuated cylinders include three hydraulic cylinders.

36. The method of claim 31, wherein the leveling step comprises adjusting one or more height adjustable legs on the transport skid such that the transport skid and the flow control unit are generally horizontal in the x-y plane relative to the ground.

37. The method of claim 35, wherein the leveling step comprises adjusting one or more of four height adjustable legs on the transport skid, each adjustable leg being hydraulically controlled.

38. The method of claim 34, wherein for the translational movement in the direction of the x-axis, the transport skid is connected to the flow control unit frame by the x-axis directional hydraulic cylinder pivotally connected between one of the frame members of the flow control unit frame and the transport skid; and for the translational movement in the direction of the y-axis, the transport skid is connected to the flow control unit frame by a pair of the y-axis directional hydraulic cylinders, each being pivotally connected between one of the skid frame members and one of the frame members of the flow control unit; and actuation of the x-axis directional hydraulic cylinder and one or both of the y-axis directional hydraulic cylinders provides the rotational movement about the z-axis.

39. The method of claim 32, further comprising, providing a friction reducing member at one or more points of contact between the transport skid and the flow control unit frame to assist in the rotation and the translational movement.

40. The method of claim 39, wherein the friction reducing member is one or more of a lubricant, a coating of a friction reducing material, and a strip or a sheet of a low friction material.

41. The method of claim 39, wherein the friction reducing member is a strip or a sheet of a low friction material.

42. The method of claim 32, further comprising, during transport and landing of the fracturing manifold module, locking the flow control unit frame to the transport skid to prevent any relative movement.

43. The method of claim 38, wherein the landing step comprises landing the flow control unit, the flow control unit frame, the transport skid, the height adjustable legs, and the plurality of cylinders as a pre-assembled transportable fracturing manifold module, and wherein the fracturing manifold module further includes a friction reducing member comprising a strip or a sheet of a low friction material at one or more points of contact between the flow control unit frame and the transport skid to assist in the rotation and the translational movement.

44. The method of claim 43, further comprising one or more of:

i. locking each of the one or more height adjustable legs after leveling;

ii. locking the flow control unit frame and the transport skid against further relative movement after aligning the inlet for connection to the shared manifold trunk line; and iii. in the event of settling of the transport skid, unlocking one or both of the steps i and ii, making further adjustments to position the inlet, and then repeating one or both of steps i and ii.

45. The method of claim 34, wherein, after aligning the inlet for connection to the shared manifold trunk line, the inlet is connected to the shared manifold trunk line, and the method is repeated for a next fracturing manifold module located adjacent to the connected fracturing manifold module, with the inlet of the next fracturing manifold module being aligned along the y-axis of the shared manifold trunk line, or along a different axis of the shared manifold trunk line.

46. The method of claim 28, wherein a flow control valve is connected in the shared manifold trunk line between one or more of the adjacent fracturing manifold modules.

47. The method of claim 45, wherein, after connecting the inlet to the shared manifold trunk line, the outlet is connected to one of the plurality of wellheads via the one or more fluid conduits.

* * * * *